United States Patent [19]

Ikenaga et al.

[11] Patent Number: 4,772,421

[45] Date of Patent: Sep. 20, 1988

[54] PROCESS FOR PRODUCING ELECTROCONDUCTIVE RESIN COMPOSITE

[75] Inventors: Yukio Ikenaga; Katsuhiko Takahashi, both of Fuji; Tsuneyoshi Okada, Kawasaki; Kenji Hijikata; Toshio Kanoe, both of Fuji, all of Japan

[73] Assignee: Polyplastics Co., Ltd., Osaka, Japan

[21] Appl. No.: 909,006

[22] Filed: Sep. 16, 1986

Related U.S. Application Data

[63] Continuation of Ser. No. 801,179, Nov. 22, 1985, abandoned.

[30] Foreign Application Priority Data

Nov. 30, 1984 [JP] Japan ..... 59-253228

[51] Int. Cl.[4] ..... H01B 1/04; H01B 1/06

[52] U.S. Cl. ..... 252/500; 252/512; 252/518; 525/356; 525/357; 524/80; 524/401

[58] Field of Search ..... 252/500, 512, 518; 525/356, 357; 524/80, 401

[56] References Cited

U.S. PATENT DOCUMENTS

| | | | |
|---|---|---|---|
| 4,394,304 | 7/1983 | Wnek | 252/518 |
| 4,488,987 | 12/1984 | Hocher et al. | 252/518 |
| 4,510,075 | 4/1985 | Lee et al. | 252/500 |
| 4,510,076 | 4/1985 | Lee et al. | 252/500 |
| 4,554,093 | 11/1985 | Aldissi | 524/80 |
| 4,565,650 | 1/1986 | Francois et al. | 252/518 |

*Primary Examiner*—Josephine Barr

*Attorney, Agent, or Firm*—Burns, Doane, Swecker & Mathis

[57] ABSTRACT

An electroconductive resin composite is produced by polymerizing at least one monomer a polymer of which is electroconductive in a matrix of a resin which exhibits the anisotropy in the melt phase to form a composite of the obtained polymer and the resin. The resin composite is obtained in the form of film and a moulded article.

18 Claims, No Drawings

PROCESS FOR PRODUCING ELECTROCONDUCTIVE RESIN COMPOSITE

This application is a continuation of application Ser. No 801,179, filed Nov. 22, 1985, now abandoned.

The present invention relates to a new process for producing an electroconductive resin composite. More particularly, the invention provides a new process for producing an electroconductive resin composite from a resin exhibiting anisotropy on melting, which is called "a thermotropic liquid crystal polymer".

STATEMENT OF PRIOR ARTS

In using polymers in electric and electronic fields, it has been thought to be a quite important problem to impart electroconductivity to them so as to prevent electromagnetic disorders. Various developments have been conducted to solve this problem. Further, investigations are being made to impart electroconductivity to polymers themselves, since such polymers can be used widely in the production of dry cells and various electronic devices.

A conventional method for imparting electroconductivity to a polymer which has insulating properties inherently comprises incorporating an electroconductive filler, flake or fiber therein. Another method comprises applying an electroconductive substance thereto to form a coating film. Typical examples of the electroconductive substances used for this purpose include carbon and metals. However, products obtained by these methods have only limited processability and moldability when forming films therefrom. Further, the product has a non-uniform conductivity microscopically and, therefore, the use thereof in electronic devices, etc. will cause difficulties.

On the other hand, intensive investigations have been made for imparting the conductivity to polymers themselves such as polyacetylene and polypyrrole. It has been known that the conductivities of conductive polymer materials such as polyacetylene vary depending on the structure thereof and the orientation of the crystals. Namely, the higher the orientation, the higher the conductivity. To realize such a high orientation of the polymer materials, films or fibers obtained therefrom must be mechanically stretched or a technique of gel spinning in a solvent is employed wherein conductive polymer materials are treated in the same manner as above. However, in the treatment of polyacetylene, the fibrils are entangled in the polymerization step and, therefore, as a mechanical stretching force applied thereon is increased, the fibrils are cut to reduce the conductivity. Thus, the degree of the orientation is limited as a matter of course. Though the problem of the cutting of the fibrils due to the entanglement may be solved by the gel spinning technique, only fibrous products can be obtained. Thus this technique cannot be employed widely for various uses.

In addition, polyacetylene is quite unstable, since it is gradually oxidized in air and the polypyrrole has difficulties in the practical use, since its strength is insufficient.

To overcome the above-mentioned defects, a process has been proposed wherein polyacetylene is prepared in a low-density polyethylene (LDPE) film (a process of M. E. Galvin and G. E. Wnek disclosed in polymer, 23 (6), 795 (1982)). However, a high orientation cannot be realized by this process and the conductivity of the product is still insufficient for use in an electronic device.

An object of the present invention is to provide a means of overcoming the above-mentioned difficulties and a conductive resin composite free from these difficulties. Another object of the invention is to realize a high orientation of conductive resins such as polyacetylene and polypyrrole by a non-mechanical means. Still another object of the invention is to improve the oxidative degradation resistance and strength of the conductive resins.

SUMMARY OF THE INVENTION

It has been known that resins exhibiting anisotropy on melting, so-called liquid crystalline resins, have a quite high orientation which can be maintained even after solidification of them and, therefore, quite excellent mechanical strengths.

The inventors have completed the present invention by utilizing the characteristics of these resins exhibiting anisotropy on melting.

The invention provides a process for manufacturing an electroconductive resin composite, which comprises the step of polymerizing at least one monomer a polymer of which is electroconductive in a matrix of a resin which exhibits the anisotropy in the melt phase to form a composite of the obtained polymer and the resin and a resin composite as obtained by the process. The resin composite of the invention is also defined to comprise a polymer being electroconductive and a resin matrix to exhibit the anisotropy in the melt phase.

A preferable monomer is selected from an acetylene compound, a vinyl compound, an aromatic compound, a polyamine compound, a polycarbonyl compound, a phenol compound, a monomer for polyphenylene sulfide and $S_2N_2$. An acetylene compound, a vinyl compound and an aromatic compound are more preferable. The most preferable monomer includes acetylene gas, acrylonitrile and pyrrole.

The polymerization step is preferably carried out in the presence of a solvent and a catalyst. A practical embodiment of the process comprises the steps of impregnating a polymerization mixture of the monomer, a catalyst and a solvent into the matrix and heating the matrix at a temperature whereby to perform the polymerization. Another practical embodiment comprises the steps of mixing a polymerization mixture of the monomer and a catalyst with the matrix so that the polymerization mixture may cover the matrix on the surface and heating the mixture at a temperature whereby to perform the polymerization. A third embodiment comprises the step of bringing the monomer into contact with the matrix at a temperature whereby to perform the polymerization.

The resin composite is practically performed when the resin matrix is in the form of film, fibers, a moulded article, a melt, powder or a solution. Film is preferable.

A suitable content of the electroconductive polymer depends on the form of the resin matrix. Even a very small amount of the polymer provides the effective result. A practical resin composite according to the invention comprises from 0.01 to 99.9 percent by weight of the polymer and from 99.9 to 0.01 percent by weight of the resin matrix.

Another definition of the invention is a process for producing a resin composite in which a structural unit compound of a polymer capable of developing electroconductivity by polymerization is polymerized in a matrix comprising a resin which exhibits anisotropy on melting to form an electroconductive polymer having a high orientation. The invention provides also an electroconductive composite having an improved strength, wherein the deterioration of the electroconductivity in air is prevented by forming a composite with a resin exhibiting anisotropy on melting.

Examples of the structural unit compounds of a polymer capable of developing the conductivity by polymerization herein include acetylene compounds such as acetylene and diacetylene; vinyl compounds such as N-vinylcarbazole and acrylonitrile; aromatic compounds such as pyrrole, carbazole, azulene, pyrene, thiophene, furan, indole and benzene; polyfunctional amines used as structural units of condensation polymers such as polyimides, polyamides and polyoxadiazole; polyfunctional carbonyl compounds; phenol compounds usable as structural units for polyphenylene ethers; dichlorobenzene/sodium sulfide compounds usable as structural units for polyphenylene sulfides; and $S_2N_2$ usable as a structural unit for polythiazyls.

In the polymerization of these structural unit compounds, solvents and reaction assistants such as catalysts and cocatalysts usually used in polymerization reactions may be used. Examples of the catalysts include Ziegler-Natta catalysts such as trialkylaluminum/titanium chloride and trialkylaluminum/alkoxytitanium compounds; Friedel-Crafts catalysts such a aluminum chloride, iron chloride, tin chloride, titanium chloride and zinc chloride; and peroxide polymerization initiators such as ketone peroxides, diacyl peroxides, hydroperoxides and dialkyl peroxides.

The polymerization reaction is carried out in a matrix of a resin exhibiting anisotropy on melting. For this purpose, film, molding, melt, powder or solution of this resin is uniformly impregnated with a solvent containing the structural unit compound of a polymer capable of developing the conductivity, catalyst and cocatalyst or, alternatively, these materials are mixed together without added solvent. The film, molding, melt, powder of solution thus treated is heated to a temperature of at least a polymerization temperature of the structural unit compound or, alternatively, it is contacted with a structural unit compound of a polymer capable of developing the conductivity, such as acetylene, at a temperature of at least a reaction temperature. The conductivity of the obtained polymer can be increased further by an ordinary process such as heating in an inert gas atmosphere to accelerate a cyclization reaction or doping. Dopants used in the doping process include those usually used, such as halides, Lewis acids, protonic acids, transition metal chlorides, antimony halides, Xe, acceptors such as oxygen acceptors, alkali metals, $R_4N^+$ and $R_4P^-$, in which R represents $CH_3$, $C_6H_5$, etc.

The resin which serves as a matrix in which the polymerization of the conductive polymer is performed according to the invention is a polymer composition which exhibits an optical anisotropy on melting and which can be processed by the thermoplastic fusion process. These resins are classified generally in a group of thermotropic liquid crystal polymers.

The polymers forming such an anisotropic molten phase have such a property that the polymer molecular chains have a regular, parallel arrangement in a molten state. Such an arrangement of the molecules is often called "a liquid crystal state" or "a nematic phase of a liquid-crystal substance". These polymers are produced generally from thin, long and flat monomers having a considerably high rigidity along the major axis of the molecule and usually containing a plurality of coaxial or parallel chain extending bonds.

The properties of the anisotropic molten phase can be determined by an ordinary polarization test using crossed nicols. More particularly, the properties can be determined with a Leitz polarizing microscope of 40 magnifications by observing a sample placed on a Leitz hot stage in a nitrogen atmosphere. The polymer is optically anisotropic. Namely, it transmits a light when it is placed in between the crossed nicols. When the sample is optically anisotropic, the polarized light can be transmitted through it even in a still (i.e., static) state.

The components of the polymer forming the above-mentioned anisotropic molten phase are as follows:

(1) One or more of aromatic and alicyclic dicarboxylic acids, (2) one or more of aromatic, alicyclic and aliphatic diols, (3) one or more of aromatic hydroxycarboxylic acids, (4) one or more of aromatic thiolcarboxylic acids, (5) one or more of aromatic dithiols and aromatic thiolphenols, and (6) one or more of aromatic hydroxyamines and aromatic diamines.

The polymers forming the anisotropic molten phase comprise the following combinations:

(I) a polyester comprising (1) and (2), (II) a polyester comprising only (3), (III) a polyester comprising (1), (2) and (3), (IV) a polythiol ester comprising only (4), (V) a polythiol ester comprising (1) and (5), (VI) a polythiol ester comprising (1), (4) and (5), (VII) a polyesteramide comprising (1), (3) and (6), and (VIII) a polyesteramide comprising (1), (2), (3) and (6).

In addition to the above-mentioned combinations of the components, the polymers forming the anisotropic molten phase include also aromatic polyazomethines such as poly(nitrilo-2-methyl-1,4-phenylenenitriloethylidine-1,4-phenylenethylidine), poly(nitrilo-2-methyl-1,4-phenylenenitrilomethylidine-1,4-phenylenemethylidine) and poly(nitrilo-2-chloro-1,4-phenylenenitrilomethylidine-1, 4-phenylenemethylidine).

Further, in addition to the above-mentioned combinations of the components, the polymers forming the anisotropic molten phase include polyester carbonates essentially comprising 4-hydroxybenzoyl, dihydroxyphenyl, dihydroxycarbonyl and terephthaloyl units.

Examples of the compounds constituting the above-mentioned polymers (I) to (VIII) include aromatic dicarboxylic acids such as terephthalic acid, 4,4'-diphenyldicarboxylic acid, 4,4'-triphenyldicarboxylic acid, 2,6-naphthalenedicarboxylic acid, diphenyl ether-4,4'-dicarboxylic acid, diphenoxyethane-4,4'-dicarboxylic acid, diphenoxybutane-4,4'-dicarboxylic acid, diphenylethane-4,4'-dicarboxylic acid, isophthalic acid, diphenyl ether-3,3'-dicarboxylic acid, diphenoxyethane-3,3'-dicarboxylic acid, diphenylethane-3,3'-dicarboxylic acid and naphthalene-1,6-dicarboxylic acid; and those substituted with alkyl and alkoxy groups and halogen atoms, such as chloroterephthalic acid, dichloroterephthalic acid, bromoterephthalic acid, methylterephthalic acid, dimethylterephthalic acid, ethylterephthalic acid, methoxyterephthalic acid and ethoxyterephthalic acid.

Examples of the alicyclic dicarboxylic acids include trans-1,4-cyclohexanedicarboxylic acid, cis-1,4-cyclohexanedicarboxylic acid and 1,3-cyclohexanedicarboxylic acid as well as those substituted with alkyl and alkoxy groups and halogen atoms, such as trans1,4-(1-methyl)cyclohexane dicarboxylic acid and trans-1,4 -(1-chloro)cyclohexanedicarboxylic acid.

Examples of the aromatic diols include hydroquinone, resorcinol, 4,4'-dihydroxydiphenyl, 4,4'-dihydroxytriphenyl, 2,6-naphthalenediol, 4,4'-dihydroxydiphenyl ether, bis(4-hydroxyphenoxy)ethane, 3,3'-dihydroxydiphenyl, 3,3'-dihydroxydiphenyl ether, 1,6-naphthalenediol, 2,2-bis(4-hydroxyphenyl)propane and 2,2-bis(4-hydroxyphenyl)methane as well as those substituted with alkyl and alkoxy groups and halogen atoms, such as chlorohydroquinone, methylhydroquinone, 1-butylhydroquinone, phenylhydroquinone, methoxyhydroquinone, phenoxyhydroquinone, 4-chlororesorcinol and 4-methylresorcinol.

Examples of the alicyclic diols include trans-1,4-cyclohexanediol, cis-1,4-cyclohexanediol, trans-1,4-cyclohexanedimethanol, cis-1,4-cyclohexanedimethanol, trans-1,3-cyclohexanediol, cis-1,2-cyclohexanediol and trans-1,3-cyclohexanedimethanol as well as those substituted with alkyl and alkoxy groups and halogen atoms, such as trans-1,4-(1-methyl)cyclohexanediol and trans-1, 4-(1-chloro)cyclohexanediol.

Examples of the aliphatic diols include straight-chain or branched aliphatic diols such as ethylene glycol, 1,3-propanediol, 1,4-butanediol and neopentyl glycol.

Examples of the aromatic hydroxycarboxylic acids include 4-hydroxybenzoic acid, 3-hydroxybenzoic acid, 6-hydroxy-2-naphthoic acid and 6-hydroxy-l-naphthoic acid as well as those substituted with alkyl and alkoxy groups and halogen atoms, such as 3-methyl-4-hydroxybenzoic acid, 3,5-dimethyl-4-hydroxybenzoic acid, 2,6-dimethyl-4-hydroxybenzoic acid, 3-methoxy-4-hydroxybenzoic acid, 3,5-dimethoxy-4-hydroxybenzoic acid, 6-hydroxy-5-methyl-2-naphthoic acid, 6-hydroxy-5 methoxy-2-naphthoic acid, 3-chloro-4-hydroxybenzoic acid, 2-chloro-4-hydroxybenzoic acid, 2,3-dichloro-4-hydroxybenzoic acid, 3,5-dichloro-4-hydroxybenzoic acid, 2,5-dichloro-4-hydroxybenzoic acid, 3-bromo-4-hydroxybenzoic acid, 6-hydroxy- 5-chloro-2 naphthoic acid, 6-hydroxy-7-chloro-2-naphthoic acid and 6-hydroxy-5,7-dichloro-2-naphthoic acid.

Examples of the aromatic mercaptocarboxylic acids include 4-mercaptobenzoic acid, 3-mercaptobenzoic acid, 6-mercapto-2-naphthoic acid and 7-mercapto-2-naphthoic acid.

Examples of the aromatic dithiols include benzene-1,4-dithiol, benzene-1,3-dithiol, 2,6-naphthaleneditiol and 2,7-naphthalenedithiol.

Examples of the aromatic mercaptophenols include 4-mercaptophenol, 3-mercaptophenol, 6-mercaptophenol and 7-mercaptophenol.

Examples of the aromatic hydroxyamines and aromatic diamines include 4-aminophenol, N-methyl-4-aminophenol, 1,4-phenylenediamine, N-methyl-l,4-phenylenedimine, N,N'-dimethyl-l,4-phenylenediamine, 3-aminophenol, 3-methyl-4-aminophenol, 2-chloro-4-aminophenol, 4-amino-1-naphthol ; 4-amino-4'-hydroxydiphenyl, 4-amino-4'hydroxydiphenyl ether, 4-amino-4'-hydroxydiphenylmethane, 4-amino-4'-hydroxydiphenyl sulfide, 4,4'-diaminophenyl sulfide (thiodianiline), 4,4'-diaminodiphenyl sulfone, 2,5-diaminotoluene, 4,4'-ethylenedianiline, 4,4'-diaminodiphenoxyethane, 4,4'-diaminodiphenylmethane (methylenedianiline) and 4,4'-diaminodiphenyl ether (oxydianiline).

The polymers (I) to (VIII) comprising the above-mentioned components may be divided into a group of those capable of forming the anisotropic molten phase and a group of those incapable of forming said phase according to the constituting components, polymers composition and sequence distribution. The polymers used in the present invention are limited to those of the former group.

Among the polymers capable of forming the anisotropic molten phase suitably used in the present inventions, the polyesters (I), (II) and (III) and polyesteramides (VIII) can be prepared by various ester forming processes wherein organic monomers each having a functional group which can form a desired recurring unit by the condensation are reacted with each other. The functional groups of these organic monomers include carboxyl, hydroxyl, ester, acyloxy, acyl halide, and amine groups. These organic monomers can be reacted by melt acidolysis in the absence of any heat exchange fluid. In this process, the monomers are heated together to form a melt. As the reaction proceeds, the solid polymer particles are suspended in the melt. In the final stage of the condensation reaction, the reaction system may be evacuated to facilitate the removal of volatile byproducts such as acetic acid and water.

A slurry polymerization process may also be employed in the preparation of fully aromatic polyesters suitable for use in the present invention. In this process, the solid product is obtained in the form of suspension thereof in a heat exchange medium.

In either of said melt acidolysis and slurry polymerization processes, organic monomeric reactants from which fully aromatic polyesters can be derived may be employed in the reaction in a modified form obtained by esterifying the hydroxyl group of the monomer at ambient temperature (i.e. in the form of their lower acyl esters). The lower acyl groups have preferably about 2 to 4 carbon atoms. Preferably, acetates of the organic, monomeric reactants are employed in the reaction.

Typical examples of the catalysts usable in both of the melt acidolysis and slurry processes include dialkyltin oxides (such as dibutyltin oxide), diaryltin oxides, titanium dioxide, antimony trioxide, alkoxytitanium silicates, titanium alkoxides, alkali metal and alkaline earth metal salts of carboxylic acids (such as zinc acetate), Lewis acids (such as $BF_3$) and gaseous acid catalysts such as hydrogen halides (e.g. HCl). The catalyst is used in an amount of generally about 0.001 to 1 wt. %, particularly about 0.01 to 0.2 wt. %, based on the monomer.

The fully aromatic polymers suitable for use in the present invention are substantially insoluble in ordinary solvents and, therefore, they are unsuitable for use in a solution processing process. However, as described above, these polymers can be processed easily by an ordinary melt processing process. Particularly preferred fully aromatic polymers are soluble in pentafluorophenol to some extent.

The fully aromatic polyesters preferably used in the present invention have a weight-average molecular weight of.generally about 2,000 to 200,000, preferably about 10,000 to 50,000, and in a particularly preferred embodiment about 20,000 to 25,000. The fully aromatic polyesteramides preferably used have a molecular weight of generally about 5,000 to 50,000, preferably about 10,000 to 30,000, for example, 15,000 to 17,000.

The molecular weight may be determined by gel permeation chromatography or other standard methods in which no polymer solution is formed, such as a method in which terminal groups of a compression-molded film are determined by infrared spectroscopy. In another method, the molecular weight of the polymer may be determined according to a light-scattering method after it is dissolved in pentafluorophenol.

When the fully aromatic polyester or polyesteramide is dissolved in pentafluorophenol at 60° C. to obtain a 0.1 wt. % solution thereof, the solution has generally an inherent viscosity (I.V.) of at least about 2.0 dl/g, for example, about 2.0 to 10.0 dl/g.

The anisotropic molten phase-forming polyesters used particularly preferably in the present invention are those containing at least about 10 molar % of a naphthalene moiety-containing recurring unit such as 6-hydroxy-2-naphthoyl, 2,6-dihydroxynaphthalene or 2,6-dicarboxynaphthalone. Preferred polyesteramides are those having a recurring unit comprising the above-mentioned naphthalene moiety and 4-aminophenol or 1,4-phenylenediamine moiety. Examples of them will now be described.

(1) Polyesters essentially comprising the following recurring units I and II:

I

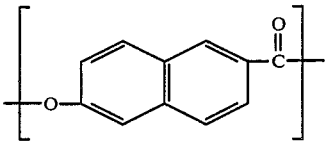

II

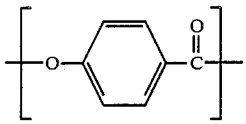

These polyesters comprise about 10 to 90 molar % of unit I and about 10 to 90 molar % of unit II. In one embodiment, unit I is contained in an amount of about 65 to 85 molar %, preferably about 70 to 80 molar % (for example, about 75 molar %). In another embodiment, unit II is contained in an amount of as small as about 15 to 35 molar %, preferably about 20 to 30 molar %. At least part of the hydrogen atoms bound directly to the ring may be replaced with a substituent selected from the group consisting of alkyl groups having 1 to 4 carbon atoms, alkoxy groups having 1 to 4 carbon atoms, halogen atoms, a phenyl group, substituted phenyl groups and combinations of them.

(2) Polyesters essentially comprising the following recurring units I, II and III:

I

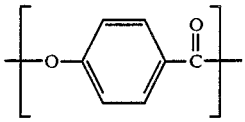

II

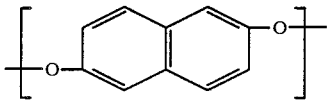

-continued

III

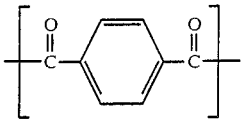

These polyesters contain about 30 to 70 molar % of unit I. They comprise preferably about 40 to 60 molar 90 of unit I, about 20 to 30 molar % of unit II and about 20 to 30 molar % of unit III. At least part of the hydrogen atoms bound directly to the ring may be replaced with a substituent selected from the group consisting of alkyl group having 1 to 4 carbon atoms, alkoxy groups having 1 to 4 carbon groups, halogen atoms, a phenyl group, substituted phenyl groups and combinations of them.

(3) Polyesters essentially comprising the following recuring units I, II, III and IV:

I

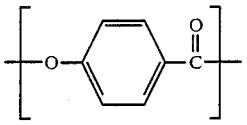

II

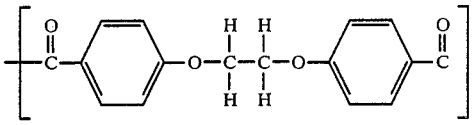

III

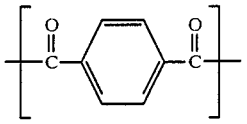

IV

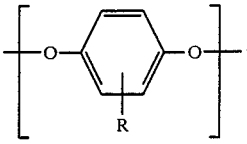

wherein R represents substituent(s) for the hydrogen atom(s) bound to the aromatic ring which are(is) methyl, chlorine, bromine or a combination of them in amounts of about 20 to 60 molar % of unit I, about 5 to 18 molar % of unit II, about 5 to 35 molar % of unit III and about 20 to 40 molar % of unit IV. Preferably, they comprise about 35 to 45 molar % of unit I, about 10 to 15 molar % of unit II, about 15 to 25 molar % of unit III and about 25 to 35 molar % of unit IV, with the proviso that the total molar concentration of units II and III is substantially equal to the molar concentration of unit IV. At least part of the hydrogen atoms bound directly to the ring may be replaced with a substituent selected from the group consisting of alkyl groups having 1 to 4 carbon atoms, alkoxy groups having 1 to 4 carbon atoms, halogen atoms, a phenyl group, substituted phenyl groups and combinations of them. When the fully aromatic polyester is dissolved in pentafluorophenol at 60° C. to obtain a 0.3 w/v % solution thereof, the solution has generally an inherent viscosity of at least 2.0 dl/g, for example, 2.0 to 10.0 dl/g.

(4) Polyesters essentially comprising the following recurring units I, II, III and IV:

I

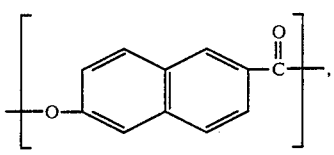

II

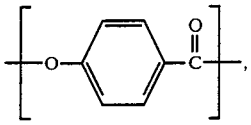

III. dioxyaryl units of the general formula: $\text{+O—Ar—O+}$ wherein Ar represents a divalent group having at least one aromatic ring, IV. dicarboxyaryl units of the general formula:

$\text{+C(=O)—Ar'—C(=O)+}$ wherein Ar' represents a divalent group having at least one aromatic ring.

The amount of unit I is about 20 to 40 molar %. The amount of unit II is larger than 10 molar % but up to about 50 molar %. The amount of unit III is larger than 5 molar % but up to about 30 molar % and that of unit IV is larger than 5 molar % but up to 30 molar %. These polyesters comprise preferably about 20 to 30 molar % (for example, about 25 molar %) of unit I, about 25 to 40 molar % (for example, about 35 molar %) of unit II, about 15 to 25 molar % (for example, about 20 molar %) of unit III and about 15 to 25 molar % (for example, about 20 molar %) of unit IV. If necessary, at least part of the hydrogen atoms bound directly to the ring may be replaced with a substituent selected from the group consisting of alkyl groups having 1 to 4 carbon atoms, alkoxy groups having 1 to 4 carbon atoms, halogens atoms, a phenyl group, substituted phenyl groups and combinations of them. The units III and IV are preferably symmetrical. More particularly, divalent bonds which connect the unit III or IV with adjacent units are arranged symmetrically on one or more aromatic rings (for example, when they are on a naphthalene ring, they are arranged in positions para to each other or on diagonal rings). However, asymmetrical units derived from resorcinol and isophthalic acid may also be used.

A preferred dioxyaryl unit III is as follows:

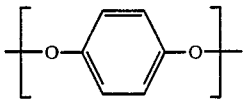

and a preferred dicarboxyaryl unit IV is as follows:

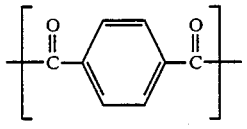

(5) Polyesters essentially comprising the following recurring units I, II and III:

I.

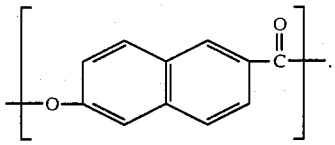

II. dioxyaryl units of the general formula: $\text{+O—Ar—O+}$ wherein Ar represents a divalent group having at least one aromatic ring, III. dicarboxyaryl units of the general formula:

$\text{+C(=O)—Ar'—C(=O)+}$ wherein Ar' represents a divalent group having at least one aromatic ring.

The amounts of units I, II and III are about 10 to 90 molar %, 5 to 45 molar % and 5 to 45 molar %, respectively. These polyesters comprise preferably about 20 to 80 molar % of unit I, about 10 to 40 molar % of unit II and about 10 to 40 molar % of unit III. More preferably, they comprise about 60 to 80 molar % of unit I, about 10 to 20 molar % of unit II and about 10 to 20 molar % of unit III. If necessary, at least part of the hydrogen atoms bound directly to the ring may be replaced with a substituent selected from the group consisting of alkyl groups having 1 to 4 carbon atoms, alkoxy groups having 1 to 4 carbon atoms, halogen atoms, a phenyl group, substituted phenyl groups and combinations of them.

A preferred dioxyaryl unit II is as follows:

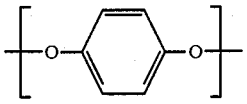

and a preferred dicarboxyaryl unit III is as follows:

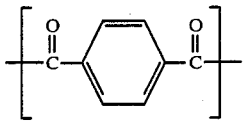

(6) Polyesteramides essentially comprising the following recurring units I, II, III and IV:

I.

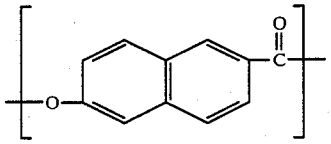

II. units of the general formula: $\text{+C(=O)—A—C(=O)+}$ wherein A represents a divalent group having at least one aromatic ring or a divalent trans-cyclohexane group, III. units of the general formula: $\text{+Y—Ar—Z+}$ wherein Ar represents a divalent group having at least one aromatic ring, Y represents O, NH or NR and Z represents NH or NR, R being an alkyl group having 1 to 6 carbon atoms or an aryl group.

IV. units of the general formula: $\text{+O—Ar'—O+}$

-continued wherein Ar' represents a divalent group having at least one aromatic ring.

The amounts of units I, II, III and IV are about 10 to 90 molar %, about 5 to 45 molar %, about 5 to 45 molar % and about 0 to 40 molar %, respectively. If necessary, at least part of the hydrogen atoms bound directly to the ring may be replaced with a substituent selected from the group consisting of alkyl groups having 1 to 4 carbon atoms, alkoxy groups having 1 to 4 carbon atoms, halogen atoms, a phenyl group, substituted phenyl groups and combinations of them.

A preferred dicarboxyaryl unit II is as follows:

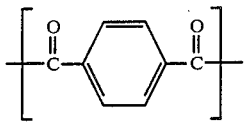

a preferred unit III is as follows:

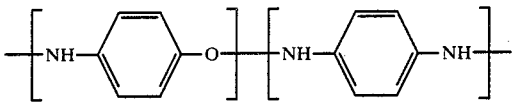

and a preferred dioxyaryl unit IV is as follows:

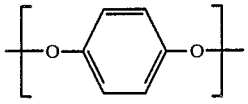

The anisotropic molten phase-forming polymers of the present invention include also those wherein part of a polymer chain comprises a segment of the above-mentioned, anisotropic molten phase-forming polymer and the balance comprises a segment of a thermoplastic resin which does not form an anisotropic molten phase.

The melt-processable polymer composition capable of forming an anisotropic molten phase used in the present invention may contain further one or more components selected from the group consisting of (1) other polymers capable of forming an anisotropic molten phase, (2) thermoplastic resins incapable of forming an anisotropic molten phase, (3) thermosetting resins, (4) low-molecular organic compounds and (5) inorganic substances. The anisotropic molten phase-forming polymer in the composition may be either thermodynamically compatible or incompatible with other components in the composition.

Examples of the thermoplastic resins (2) include polyethylene, polypropylene, polybutylene, polybutadiene, polyisoprene, polyvinyl acetate, polyvinyl chloride, polyvinylidene chloride, polystyrene, acrylic resin, ABS resin, AS resin, BS resin, polyurethane, silicone resin, fluororesin, polyacetal, polycarbonate, polyethylene terephthalate, polybutylene terephthalate, aromatic polyester, polyamide, polyacrylonitrile, polyvinyl alcohol, polyvinyl ether, polyetherimide, polyamideimide, polyether etherimide, polyether ether ketone, polyether sulfone, polysulfone, polyphenylene sulfide and polyphenylene oxide.

Examples of the thermosetting resins (3) include phenolic, epoxy, melamine, urea, unsaturated polyester, and alkyd resins.

Examples of the low-molecular organic compounds (4) are those usually incorporated in thermoplastic and thermosetting resins, such as plasticizers, antioxidants, light or weather stabilizers, e.g. U.V. absorbers, nucleating agents, antistatic agents, flame retardants, colorants, e.g. dyes and pigments, foaming agents, crosslinking agents, e.g. divinyl compounds, peroxides and vulcanizing agents and lubricants used for improving the fluidity and mold release properties.

Examples of the inorganic substances (5) are those usually incorporated in thermoplastic and thermosetting resins, such as ordinary inorganic fibers, e.g. glass fibers, carbon fibers, metal fibers, ceramic fibers, boron fibers and asbestos; powders such as calcium carbonate, highly dispersible silicic acid, alumina, aluminum hydroxide, talc powder, mica, glass flakes, glass beads, quartz powder, siliceous sand, metal powders, carbon black, barium sulfate and calcined gypsum; and whiskers of inorganic compounds, e.g. silicon carbide, alumina, boron nitride and silicon nitride as well as metal whiskers.

In the polymer composition of the present invention, the polymer chains are highly oriented even in a still (i.e., static), state in the melting step and the degree of orientation is further increased by the flow of the melt in the melt molding step. Therefore, a quite high orientation can be exhibited when the composition is molded into a two-dimensional article such as a thin molding. Accordingly, when an electroconductive polymer such as polyacetylene is polymerized in a matrix comprising said composition, the resulting resin composite has a high orientation and a high electroconductivity. When a thick molding is to be treated, it is possible to make only the surface thereof electroconductive by using a suitably selected impregnation solvent. Further, a desired figure can be realized on the resin surface by, for example, a masking method. The suitable amount of the electroconductive polymer is generally 2% based on the homogeneous composite. When only the surface of the molding is made electroconductive, the amount of said compound is not limited.

[EFFECTS OF THE INVENTION]

The electroconductive material obtained according to the present invention may be used as a material for solar batteries in the form of a sheet having a large area and a high efficiency, polymer batteries having a high power density, high-energy batteries, sensors such as thermosensers, electronic devices, display elements, circuit diagrams and electromagnetic shields.

[EXAMPLES]

Polymers A, B, C and D forming an anisotropic molten phase and used in the following examples are those comprising the following structural units together with the mole percentages of each unit:

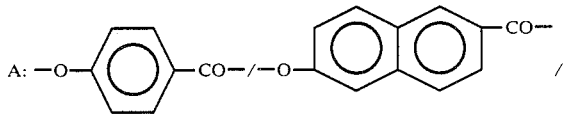

-continued

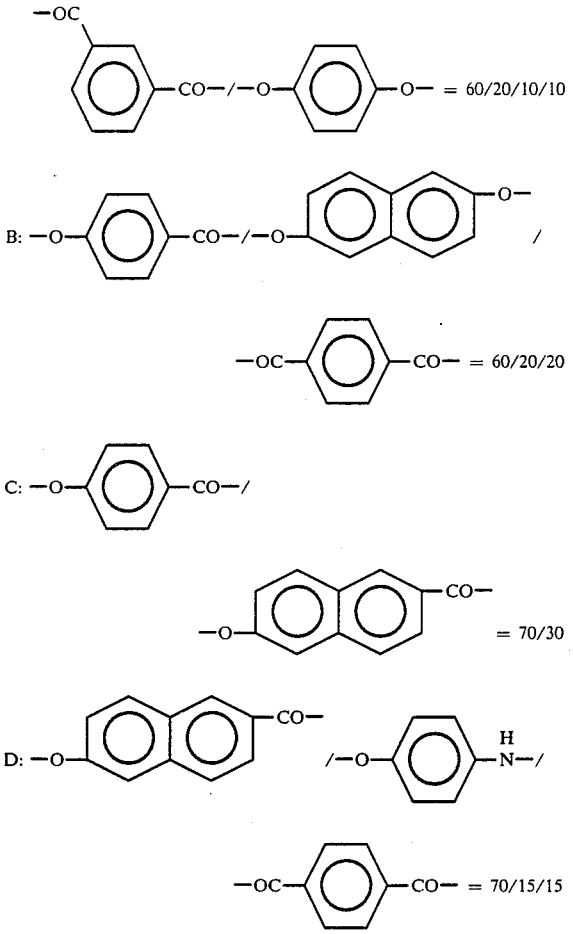

Processes for the preparation of resins A, B, C and D will now be described.

<Resin A>

1081 parts (by weight, the same shall apply hereinafter) of 4-acetoxybenzoic acid, 460 parts of 6-acetoxy-2-naphthoic acid, 166 parts of isophthalic acid and 194 parts of 1,4-diacetoxybenzene were fed to a reactor provided with a stirrer, a nitrogen inlet tube and a distillation tube. The mixture was heated to 260° C. in nitrogen stream and stirred violently at that temperature for 2.5 h and then at 280° C. for 3 h while acetic acid was distilled off from the reactor. The temperature was elevated to 320° C. and nitrogen introduction was stopped. The pressure in the reactor was reduced gradually to 0.1 mmHg after 15 min. The mixture was stirred at that temperature under that pressure for 1 h.

The obtained polymer had a concentration of 0.1 wt. % and an intrinsic viscosity of 5.0 as determined in pentafluorophenol at 60° C.

<Resin B>

1081 parts of 4-acetoxybenzoic acid, 489 parts of 2,6-dicetoxynaphthalene and 332 parts of terephthalic acid were fed to a reactor provided with a stirrer, a nitrogen inlet tube and a distillation tube. The mixture was heated to 250° C. in nitrogen stream and stirred violently at that temperature for 2 h and then at 280° C. for 2.5 h while acetic acid was distilled off from the reactor. The temperature was elevated to 320° C. and the nitrogen introduction was stopped. The pressure in the reactor was reduced gradually to 0.2 mmHg after 30 min. The mixture was stirred at that temperature under that pressure for 1.5 h.

The obtained polymer had a concentration of 0.1 wt. % and an intrinsic viscosity of 2.5 as determined in pentafluorophenol at 60° C.

<Resin C>

1261 parts of 4-acetoxybenzoic acid and 691 parts of 6-acetoxy-2-naphthoic acid were placed in a reactor provided with a stirrer, a nitrogen inlet tube and a distillation tube. The mixture was heated to 250° C. in nitrogen stream and stirred violently at that temperature for 3 h and then at 280° C. for 2 h while acetic acid was distilled off from the reactor. The temperature was elevated to 320° C. and the nitrogen introduction was stopped. The pressure in the reactor was reduced gradually to 0.1 mmHg after 20 min. The mixture was stirred at that temperature under that pressure for 1 h.

The obtained polymer had a concentration of 0.1 wt. % and an intrinsic viscosity of 5.4 as determined in pentafluorophenol at 60° C.

<Resin D>

1612 parts of 6-acetoxy-2-naphthoic acid, 290 parts of 4-acetoxyacetanilide, 249 parts of terephthalic acid and 0.4 parts of sodium acetate were placed in a reactor provided with a stirrer, a nitrogen inlet tube and a distillation tube. The mixture was heated to 250° C. in nitrogen stream and stirred violently at that temperature for 1 h and then at 300° C. for 3 h while acetic acid was distilled off from the reactor. The temperature was elevated to 340° C. and the nitrogen introduction was stopped. The pressure in the reactor was reduced gradually to 0.2 mmHg after 30 min. The mixture was stirred at that temperature under that pressure for 30 min.

The obtained polymer had a concentration of 0.1 wt. % and an intrinsic viscosity of 3.9 as determined in pentafluorophenol at 60° C.

EXAMPLE 1

10 parts of resin A and 0.01 mol of tetrabutoxytitanium were heated to a resin temperature of 280° C. in a dry nitrogen atmosphere. A film having a thickness of 0.10 mm and a width of 15 mm was prepared therefrom by means of a bench extruder. The drawdown rate in this step was 14.0. The resulting film was immersed in a mixture of 0.03 mol of triethylaluminum and 20 ml of benzene and reflux was performed for 60 min. The benzene solution was removed from the flask under reduced pressure and then acetylene gas cooled to −78° C. was introduced therein for 60 min while the temperature in the flask was raised slowly to 100° C.

Film pieces were doped in a hexachloroisopropanol-/$I_2$ solution for 24 h and then washed with a solvent. After degassing, four-terminal electrodes were fixed on the pieces with a silver paste and the electric resistance thereof was determined.

EXAMPLE 2

The same procedure as in Example 1 was repeated except that resin A was replaced with resin C.

EXAMPLE 3

50 parts of hexafluoroisopropanol was added to a solution of 2 parts of resin B in 100 parts of pentafluorophenol. The resulting solution was placed in a cylindrical flask having a cock at the bottom thereof. The solution was drawn under gentle stirring. After washing with a solvent mixture of hexafluoroisopropanol and toluene, the wash solution was removed. A solution of 0.01 mol of tetrabutoxytitanium and 0.03 mol of triethylaluminum in 20 ml of toluene was poured into the flask. After curing by heating to 80° C. in a nitrogen atmosphere for 2 h, the solvent was removed. Acetylene having a temperature of −78° C. was introduced therein under reduced pressure and the mixture was heated slowly to 100° C.

The resulting film pieces were doped in the same manner as in Example 1 and the electric resistance thereof was determined. The results are shown in Table 1.

EXAMPLES 4 and 5

The same procedure as in Example 3 was repeated except that resin B was replaced with resin C or D.

EXAMPLE 6

10 parts of resin B and 0.01 mol of trichloroaluminum were heated to a resin temperature of 280° C. in a dry nitrogen atmosphere. A film having a thickness of 0.10 mm and a width of 15 mm was prepared therefrom by means of a bench extruder.

Pieces of the resulting film were cured in the presence of 5 ml of pyrrole in a solvent mixture of 10 ml of pentafluorophenol and 10 ml of hexafluoroisopropanol for 24 h.

The pieces were then taken out and heated to 80° C. for 60 min.

The resulting film was doped with perchloric acid in the same manner as in Example 1 and the electric resistance thereof was determined.

EXAMPLE 7

The same procedure as in Example 6 was repeated except that resin B was replaced with resin C.

EXAMPLE 8

50 parts of hexafluoroisopropanol was added to a solution of 2 parts of resin C in 100 parts of pentafluorophenol. The resulting solution was placed in a cylindrical flask having a cock at the bottom thereof. 0.001 mol of trichloroaluminum was added thereto under stirring and then 5 ml of pyrrole was added to the mixture. The mixture was stirred at 60° C. for 3 h and then cooled. The solution was drawn out under gentle stirring. The heating was effected at 80° C. under reduced pressure for 60 min.

The electric resistance of the resulting film was determined in the same manner as in Example 6.

EXAMPLE 9

The same solution containing 5 ml of pyrrole as in Example 8 was drawn out under gentle stirring and cooling. After heating at 80° C. for 60 min, a film was obtained. The electric resistance of the resulting film was determined in the same manner as in Example 6.

EXAMPLE 10

The same solution containing 5 ml of pyrrole as in Example 8 was applied to a clean glass plate and heated at 80° C. for 60 min to obtain a film. The electric resistance of the resulting film was determined in the same manner as in Example 6.

EXAMPLE 11

Monofilaments obtained by the extrusion in the same manner as in Example 7 were cut into pellets, which were then molded into a film having a thickness of 0.15 mm by means of a hot press. The electric resistance of pieces of the film was determined in the same manner as in Example 7.

EXAMPLE 12

50 parts of hexafluoroisopropanol was added to a solution of 2 parts of resin C in 100 parts of pentafluorophenol. The solution was placed in a cylindrical flask having a cock at the bottom thereof. 0.001 mol of benzoyl peroxide was added thereto under stirring and then 5 ml of acrylonitrile was added slowly to the mixture.

The solution was drawnout through the bottom under gentle stirring and cooling, gradually heated to 70° C. and cured by heating for 2 h.

After heating to 200° C. in nitrogen stream for additional 3 h, pieces of the resulting film were heated to 400° C. in a nitrogen atmosphere in a glass tube for 2 h.

COMPARATIVE EXAMPLES 1 to 4

The electric resistances of films of resins A, B, C and D were determined.

COMPARATIVE EXAMPLE 5

An LDPE film having a thickness of 0.3 mm was immersed in a solution comprising 60 ml of toluene, 3.75 ml of tetrabutoxytitanium and 6 ml of triethylaluminum in a nitrogen atmosphere for 24 h and then the film was heated to 70° C. for 1.5 h. After cooling and washing, toluene was removed under reduced pressure. Acetylene gas was passed therein and the product was heated from −78° C. gradually to 110° C.

The resulting film was doped with $I_2$ for 24 h and the electric resistance thereof was determined.

COMPARATIVE EXAMPLE 6

A polybutylene terephthalate film having a thickness of 0.3 mm was treated in the same manner as in Comparative Example 5 except that a mixture of toluene and methylene trichloride was used as the solvent.

COMPARATIVE EXAMPLE 7

20 ml of toluene, 3.4 ml of tetrabutoxytitanium and 4.1 ml of triethylaluminum were placed in a Schlenk's flask in a nitrogen atmosphere. The mixture was stirred at room temperature for 30 min and then cooled to -78° C. After degassing under reduced pressure, the flask was turned sideways and acetylene gas was introduced therein under rotation for 60 min. A film having a thickness of about 100 $\mu$ was obtained, which was doped with $I_2$ in the same manner as in Comparative Example 5.

The films and the electric resistances of them obtained in the above examples and comparative examples are summarized in Table 1.

TABLE 1

| Ex. | Resin | Structural unit | Electroconductivity S/cm |
|---|---|---|---|
| Comp. Ex. 1 | A | — | $8 \times 10^{-17}$ |
| Comp. Ex. 2 | B | — | $9 \times 10^{-17}$ |
| Comp. Ex. 3 | C | — | $5 \times 10^{-17}$ |
| Comp. Ex. 4 | D | — | $1 \times 10^{-16}$ |
| Ex. 1 | A | acetylene | $7 \times 10$ |
| Ex. 2 | C | " | $1 \times 10^{2}$ |

TABLE 1-continued

| Ex. | Resin | Structural unit | Electroconductivity S/cm |
|---|---|---|---|
| Ex. 3 | B | " | $6 \times 10$ |
| Ex. 4 | C | " | $6 \times 10$ |
| Ex. 5 | D | " | $7 \times 10$ |
| Ex. 6 | B | pyrrole | $1 \times 10^2$ |
| Ex. 7 | C | " | $2 \times 10^2$ |
| Ex. 8 | C | " | $1 \times 10^2$ |
| Ex. 9 | C | " | $9 \times 10$ |
| Ex. 10 | C | " | $4 \times 10$ |
| Ex. 11 | C | " | $2 \times 10$ |
| Ex. 12 | C | acrylonitrile | $7 \times 10$ |
| Comp. Ex. 5 | LDPE | acetylene | $5 \times 10^0$ |
| Comp. Ex. 6 | PBT | " | $1 \times 10^0$ |
| Comp. Ex. 7 | — | " | $5 \times 10$ |

EXAMPLE 13

The film obtained in Example 2 was left to stand in air and changes in the electric resistace thereof with time was examined. The results are shown in Table 2. The numerical values refer to the ratios relative to an initial value.

COMPARATIVE EXAMPLE 8

The film obtained in Comparative Example 7 was tested in the same manner as in Example 13.

TABLE 2

| | Changes in electric resistance with time in air ($\delta/\delta_o$) | | |
|---|---|---|---|
| | 10 days | 20 days | 30 days |
| Ex. 13 | $2 \times 10^{-1}$ | $1 \times 10^{-1}$ | $8 \times 10^{-2}$ |
| Comp. Ex. 8 | $7 \times 10^{-2}$ | $1 \times 10^{-2}$ | $9 \times 10^{-3}$ |

The tensile strengths of the films obtained in Example 2 and Comparative Example 5 and 6 are shown in Table 3.

TABLE 3

| | Base resin | Conductive polymer | Tensile strength (MPa) |
|---|---|---|---|
| Ex. 2 | Liquid crystal resin | Polyacetylene | 470 |
| Comp. Ex. 5 | LDPE | " | 23 |
| Comp. Ex. 6 | PBT | " | 51 |

The embodiments of the invention in which an exclusive privilege or property is claimed are defined as follows:

1. An improved process for manufacturing an electroconductive resin composite comprising (a) polymerizing a monomer in the presence of a highly oriented polymeric matrix in a configuration selected from the group consisting of fibers, films, and molded articles comprising a polymer selected from the group consisting of polyesters, polyesteramides, aromatic polyazomethines, and polycarbonates which is capable of forming an anisotropic melt phase wherein said monomer following polymerization is capable of being rendered electroconductive and is selected from the group consisting of acetylene, acrylonitrile, and pyrrole, and (b) contacting said polymer present within said matrix with an effective amount of a dopant in order to increase its electroconductivity.

2. An improved process for manufacturing an electroconductive resin composite according to claim 1 wherein step (a) is carried out at an elevated polymerization temperature in the presence of a polymerization catalyst and a solvent for said monomer.

3. An improved process for manufacturing an electroconductive resin composite according to claim 1 wherein in step (a) said monomer is provided primarily at the surface of said polymer which is capable of forming an anisotropic melt phase.

4. An improved process for manufacturing an electroconductive resin composite according to claim 1 wherein said dopant employed in step (b) is selected form the group consisting of halogens, Lewis acids, and protonic acids.

5. An improved process for manufacturing an electroconductive resin composite according to claim 1 wherein said electroconductive polymer is present in said composite in a concentration of approximately 2 percent by weight.

6. An improved process for manufacturing an electroconductive resin composite according to claim 1 wherein said polymer which is capable of forming an anisotropic melt phase includes at least 10 mole percent of repeating units which include a naphthalene moiety selected from the group consisting of 6-oxy-2-naphthoyl moiety, 2,6-dioxynaphthalene moiety, 2,6-dicarboxynaphthalene moiety, and mixtures of the foregoing.

7. An improved process for manufacturing an electroconductive resin composite according to claim 1 wherein said polymer which is capable of forming an anisotropic melt phase exhibits an inherent viscosity of at least about 2.0 dl./g. when dissolved in a concentration of 0.1 percent by weight in pentafluorophenol at 60° C.

8. An improved process for manufacturing an electroconductive resin composite according to claim 1 wherein said polymer which is capable of forming an anisotropic melt phase exhibits an inherent viscosity of about 2.0 to 10.0 dl./g when dissolved in a concentration of 0.1 percent by weight in pentafluorophenol at 60° C.

9. An improved process for manufacturing an electroconductive resin composite according to claim 1 wherein said polymer which is capable of forming an anisotropic melt phase is a wholly aromatic polyester.

10. An improved process for manufacturing an electroconductive resin composite according to claim 1 wherein said polymer which is capable of forming a anisotropic melt phase is a polyester which consists essentially of the recurring moieties I and II which may include substitution of at least some of the hydrogen atoms present upon an aromatic ring wherein:

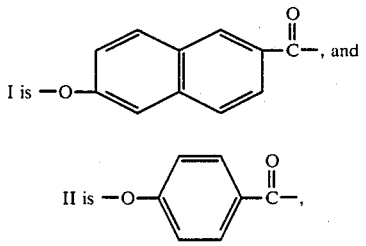

with said substitution if present being selected from the group consisting of an alkyl group of 1 to 4 carbon atoms, an alkoxy group of 1 to 4 carbon atoms, halogen, phenyl, substituted phenyl, and mixtures of the foregoing, and wherein said polyester comprises approximately 10 to 90 mole percent of moiety I, and approximately 10 to 90 mole percent of moiety II.

11. An improved process for manufacturing an electroconductive resin composite according to claim 10 wherein moiety I is present in concentration of approximately 65 to 85 molde percent and moiety II is present in concentration of approximately 15 to 35 mole percent.

12. An improved process for manufacturing an electroconductive resin composite according to claim 1 wherein said polymer which is capable of forming an anisotropic melt phase is a polyester which consists essentially of recurring moeities I, II, and III which may include substitution of at least some of the hydrogen atoms present upon an aromatic ring wherein:

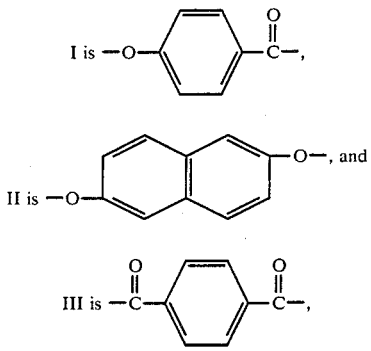

with said substitution if present being selected from the group consisting of an alkyl group of 1 to 4 carbon atoms, an alkoxy group of 1 to 4 carbon atoms, halogen, phenyl, substituted phenyl, and mixtures of the foregoing, and wherein said polyester comprises about 30 to 70 mole percent of moiety I.

13. An improved process for manufacturing an electroconductive resin composite according to claim 1 wherein said polymer which is capable of forming an anisotropic melt phase is a polyester which consists essentially of the recurring moieties I, II, III and IV wherein:

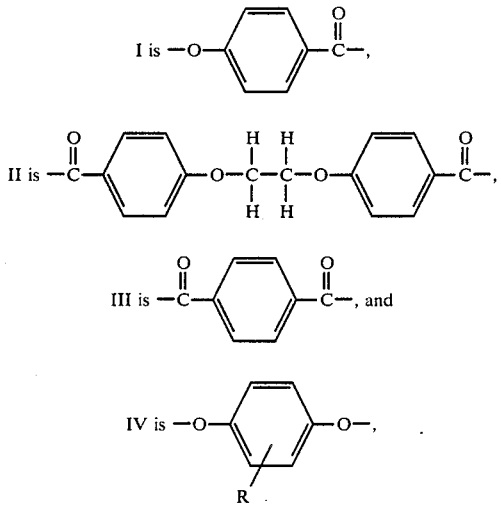

where R is methyl, chloro, bromo, and mixtures thereof, and is substituted for a hydrogen atom present upon the aromatic ring, and wherein the polyester comprises about 20 to 60 mole percent of moiety I, about 5 to 18 mole percent of moiety II, about 5 to 35 mole percent of moiety III, and about 20 to 40 mole percent of moiety IV.

14. An improved process for manufacturing an electroconductive resin composite according to claim 1 wherein said polymer which is capable of forming an anisotropic melt phase is a polyester which consists essentially of the recurring moieties I, II, III and IV which may include substitution of at least some of the hydrogen atoms present upon an aromatic ring wherein:

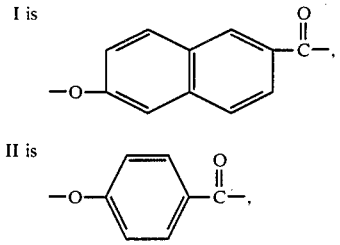

III is a dioxyaryl moiety of the formula —O—Ar—O— where Ar is a divalent radical comprising at least one aromatic ring, and IV is a dicarboxyaryl moiety of the formula

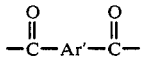

where Ar' is a divalent radical comprising at least one aromatic ring, with said substitution if present being selected from the group consisting of an alkyl group of 1 to 4 carbon atoms, an alkoxy group of 1 to 4 carobn atoms, halogen, phenyl, substituted alkxoy group of I to 4 carbon atoms, halogen, phenyl, substituted phenyl, and mixtures of the foregoing, and wherein said polyester comprises about 20 to 40 mole percent of moiety I, in excess of 10 mole percent but less than about 50 mole percent of moiety II, in excess of 5 mole percent but less than about 30 mole percent of moiety III, and in excess of 5 mole percent but less than 30 mole percent of moiety IV.

15. An improved process for manufacturing an electroconductive resin composite according to claim 1 wherein said polymer which is capable of forming an anisotropic melt phase is polyester which consists essentially of the recurring moieties I, II, and III which may include substitution of at least some of the hydrogen atoms present upon an aromatic ring wherein:

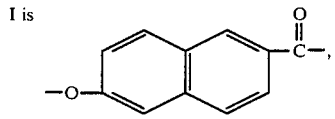

II is a dioxyaryl moiety of the formula —O—Ar—O— where Ar is a divalent radical comprising at least one aromatic ring, and III is a dicarboxyaryl moiety of the formula

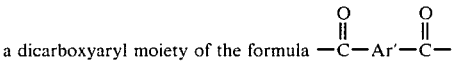

where Ar' is a divalent radical comprising at least one aromatic ring, with said substitution if present being selected from the group consisting of an alkyl group of 1 to 4 carbon atoms, an alkoxy group of 1 to 4 carbon atoms, halogen, phenyl, substituted phenyl, and mixtures of the foregoing, and wherein said polyester comprises about 10 to 90 mole percent of moiety I, about 5 to 45 mole percent of moiety II, and about 5 to 45 mole percent of moiety III.

16. An improved process for manufacturing an electroconductive resin composite according to claim 1 wherein said polymer which is capable of forming an anisotropic melt phase is a polyesteramide which consists essentially of the recurring moieties I, II, III, and optionally IV, wherein:

I is 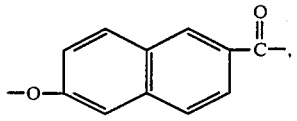

II is $-\overset{O}{\overset{\|}{C}}-A-\overset{O}{\overset{\|}{C}}-$ where A is a divalent radical comprising at least one aromatic ring or a divalent transcyclohexane radical, III is $-Y-Ar-Z-$ where Ar is a divalent radical comprising at least one aromatic ring, Y is O, NH, or NR, and Z is NH or NR, where R is an alkyl group having 1 to 6 carbon atoms or an aryl group, and IV is $-O-Ar'-O-$ where Ar' is a divalent radical comprising at least one aromatic ring, wherein at least some of the hydrogen atoms present upon the aromatic rings optionally may be replaced by substitution selected from the group consisting of an alkyl group of 1 to 4 carbon atoms, an alkoxy group of 1 to 4 carbon atoms, halogen, phenyl, substituted phenyl, and mixtures of the foregoing, and wherein said poly-esteramide comprises about 10 to 90 mole percent of moiety I, about 5 to 45 mole percent of moiety II, about 5 to 45 mole percent of moiety III, and about 0 to 40 mole percent of moiety IV.

17. An improved process for manufacturing an electroconductive resin composite according to claim 16 wherein moiety I is present in a concentration of about 70 mole percent, moiety II is

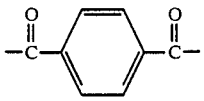

and is present in a concentration of about 15 mole percent, moiety III is

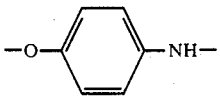

and is present in a concentration of about 15 mole percent, and moiety IV is absent.

18. An improved electroconductive resin composite formed by the process of claim 1.

* * * * *